US009939226B2

(12) United States Patent
Seymore et al.

(10) Patent No.: US 9,939,226 B2
(45) **Date of Patent: *Apr. 10, 2018**

(54) FIREARM TRAINING APPARATUS AND METHOD

(71) Applicant: The United States of America, as represented by the Secretary of Homeland Security, Washington, DC (US)

(72) Inventors: Jody Seymore, Altoona, PA (US); Jason Edwards, Altoona, PA (US); Jeffrey Browder, Altoona, PA (US); Brian Marks, Altoona, PA (US)

(73) Assignee: The United States of America, as represented by the Secretary of Homeland Security, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/247,339

(22) Filed: Aug. 25, 2016

(65) Prior Publication Data

US 2016/0363409 A1 Dec. 15, 2016

Related U.S. Application Data

(63) Continuation of application No. 14/869,182, filed on Sep. 29, 2015, now Pat. No. 9,441,904.

(Continued)

(51) Int. Cl.
*F41A 33/00* (2006.01)
*F41A 3/12* (2006.01)

(Continued)

(52) U.S. Cl.
CPC ..... *F41A 33/00* (2013.01); *F41A 3/12* (2013.01); *F41A 3/26* (2013.01); *F41A 5/26* (2013.01);

(Continued)

(58) Field of Classification Search
CPC ..... F41A 17/44; F41A 17/64; F41A 17/00; F41A 17/42; F41A 33/00; F41A 3/68; F41A 19/13
See application file for complete search history.

(56) References Cited

U.S. PATENT DOCUMENTS 3,771,415 A 11/1973 Into
4,246,830 A * 1/1981 Krieger ..... F41A 19/13 89/132

(Continued)

OTHER PUBLICATIONS

Specifications for the Adaptation of Shotgun Magazines and the Deactivation of Firearms, Revised 2010.*

*Primary Examiner* — Benjamin P Lee
(74) *Attorney, Agent, or Firm* — Lavanya Ratnam; Trenton Roche; Nathan Grebasch

(57) ABSTRACT

This application is directed to a firearm that is functional, but is not fully functional as it is incapable of discharging ammunition, e.g., causing ammunition to ignite and discharge a bullet. Related methods, techniques, and approaches are also discussed. In embodiments, the firearm is functional, but not fully functional and it is impractical and/or irreversible to alter the firearm to make it fully functional through replacement of interchangeable parts that correspond to that particular firearm model. In embodiments, the firearm is also identifiable as being less than fully functional, e.g., it is incapable of discharging ammunition.

19 Claims, 12 Drawing Sheets

Related U.S. Application Data

(60) Provisional application No. 62/057,628, filed on Sep. 30, 2014.

(51) Int. Cl.

| | |
|---|---|
| ***F41A 19/13*** | (2006.01) |
| ***F41A 19/14*** | (2006.01) |
| ***F41A 3/26*** | (2006.01) |
| ***F41A 17/44*** | (2006.01) |
| ***F41A 5/26*** | (2006.01) |

(52) U.S. Cl.
CPC ..... *F41A 17/44* (2013.01); *F41A 19/13* (2013.01); *F41A 19/14* (2013.01)

(56) References Cited

U.S. PATENT DOCUMENTS

| | | | | |
|---|---|---|---|---|
| 4,501,081 | A * | 2/1985 | Izumi | F41A 17/44 42/70.01 |
| 4,761,907 | A | 8/1988 | De Bernardini | |
| 4,969,283 | A | 11/1990 | Baehr | |
| H926 | H * | 6/1991 | Mahtook | F41A 11/02 42/77 |
| 6,240,670 | B1 | 6/2001 | Findlay | |
| 6,634,129 | B1 * | 10/2003 | Freeman, Jr. | F41A 3/26 42/69.02 |
| 6,935,864 | B2 | 8/2005 | Shechter | |
| 7,581,954 | B2 * | 9/2009 | Schavone | F41B 11/51 124/74 |
| 7,753,679 | B1 | 7/2010 | Schuetz | |
| 7,832,136 | B2 | 11/2010 | Rush | |
| 8,764,446 | B2 * | 7/2014 | Landies | F41A 33/00 434/11 |
| 9,057,577 | B2 | 6/2015 | Hannan | |
| 9,441,904 | B2 * | 9/2016 | Seymore | F41A 33/00 |
| 2003/0056778 | A1 * | 3/2003 | Schavone | F41B 11/51 124/74 |
| 2003/0066096 | A1 * | 4/2003 | Bryan | A23G 3/366 800/8 |
| 2003/0177896 | A1 | 9/2003 | Dionne | |
| 2003/0221351 | A1 | 12/2003 | Barber | |
| 2005/0257412 | A1 * | 11/2005 | Quis | F41A 33/00 42/71.01 |
| 2009/0229159 | A1 | 9/2009 | Roth | |
| 2009/0260269 | A1 * | 10/2009 | Vanvlymen | F41A 3/12 42/69.02 |
| 2011/0207088 | A1 | 8/2011 | Uhr | |
| 2011/0281242 | A1 | 11/2011 | Charles | |
| 2011/0306019 | A1 * | 12/2011 | Landies | F41A 33/00 434/16 |
| 2016/0091271 | A1 * | 3/2016 | Seymore | F41A 5/26 42/16 |

* cited by examiner

FIREARM TRAINING APPARATUS AND METHOD

CROSS-REFERENCE TO RELATED APPLICATIONS

This application is a continuation of and claims priority under 35 U.S.C. § 120 to U.S. patent application Ser. No. 14/869,182, entitled Firearm Training Apparatus and Method, filed Sep. 29, 2015 and issuing as U.S. Pat. No. 9,441,904, which claims the benefit of priority under 35 U.S.C. § 119(e) to U.S. Provisional Patent Application No. 62/057,628, entitled Training Gun, Method for Producing A Training Gun, filed on Sep. 30, 2014. The contents of these applications are incorporated by reference in their entirety.

GOVERNMENT RIGHTS

This invention was made with United States Government support. The Government has certain rights in this invention.

BACKGROUND

Field of the Disclosure

This application relates generally to a training firearm that is functional but incapable of firing live ammunition. The present disclosure also relates to methods for modifying a fully functional firearm into a readily identifiable firearm capable of functioning, but incapable of firing live ammunition.

Description of the Related Art

Law enforcement and military personnel routinely train with firearms. Examples of such firearms include, but are not limited to, rifles and carbines such as the M4 and its civilian variant, the AR15. Both the AR15 and M4 are generally similar to an M16. These firearms, also referred to as firearms, are popular and very well-regarded for their versatility, reliability, and accuracy. As a result, there is a large demand for firearms training for firearms such as the M4/M16/AR15.

Firearms training, whether civilian, law enforcement, or military is usually divided into two segments, range training and classroom training. Range training involves training students with live ammunition, e.g., ammunition with a bullet or projectile, and fully functional firearm. Classroom training precedes range training and is often interspersed with range time. Classroom training is used to prepare students for the range and better understand how firearms function, safety principles, and how to improve as a shooter. Classroom training covers a broad array of topics, but typically, focuses, on firearm safety, firearm design and operation, and reviewing the students range performance.

Often times classroom training involves showing or demonstrating how the firearm operates. "Hands on" classroom training is particularly effective as students are able to see how the firearm functions and manipulate it. At times a fully functional firearm, that is capable of firing a bullet, is used as part of classroom training to show features of the firearm. A fully functioning firearm is a firearm that is configured to fire a cartridge, e.g., propel a bullet out of the firearm. Use of a fully functional firearm in a non-range setting, such as in a classroom, is problematic. Although the vast majority of firearms instructors and students place a high degree of attention on safety, a fully functioning firearm does have the ability to fire a cartridge at times referred to as ammunition.

Cartridge ammunition can be broken into two main categories, rimfire and centrefire. As used herein the ammunition described will be centerfire cartridge ammunition. Centerfire cartridge ammunition has four main components which include the cartridge case or shellcase, primer, powder and bullet or projectile. The shellcase is typically made of brass and is used to contain or properly hold the other three components in their places. The primer located in the shellcase head is used to ignite a small explosive charge which in turn ignites the powder. The powder which is located in the shellcase is used to propel the bullet down the firearms barrel. The bullet or projectile is located at the opposite end of the shellcase head and is used to damage, maim or kill. In operation, the firearm activates or fires the ammunition by a firing pin striking the primer.

Use of ammunition without a bullet, e.g., a blank, while useful in some training scenarios can cause potential safety issues. For example, live ammunition may be confused with blanks. Also, while a blank does not include a bullet, it can be very loud in an enclosed space. Also, a blank can cause damage due to the concussive force created by the propellant/primer. This concussive force or muzzle blast can still cause damage. Another potential issue with blanks is that a blank can propel any object placed or lodged in the barrel.

Dummy rounds, a cartridge that (typically) does not include either a primer or propellant, are also used in training. These cartridges may include a bullet, but are non-functional as they do not include a primer or propellant which propels the bullet. One example is a snap cap, which is a type of dummy round that can be used when a user wants to "dry fire" a firearm without discharging a bullet.

SUMMARY

This document is directed to a firearm that is functional, but is not fully functional as it is incapable of discharging ammunition, e.g., causing ammunition to ignite and discharge a bullet. Related methods, techniques, and approaches are also discussed. In embodiments, the firearm is functional, but not fully functional and it is impractical and/or irreversible to alter the firearm to make it fully functional through replacement of interchangeable parts that correspond to that particular firearm model. In embodiments, the firearm is also identifiable as being less than fully functional, e.g., it is incapable of discharging ammunition.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

A more complete appreciation of the disclosed embodiments and many of the attendant advantages thereof will be readily obtained as the same becomes better understood by reference to the following detailed description when considered in connection with the accompanying drawings, wherein.

DETAILED DESCRIPTION

Figure 1:
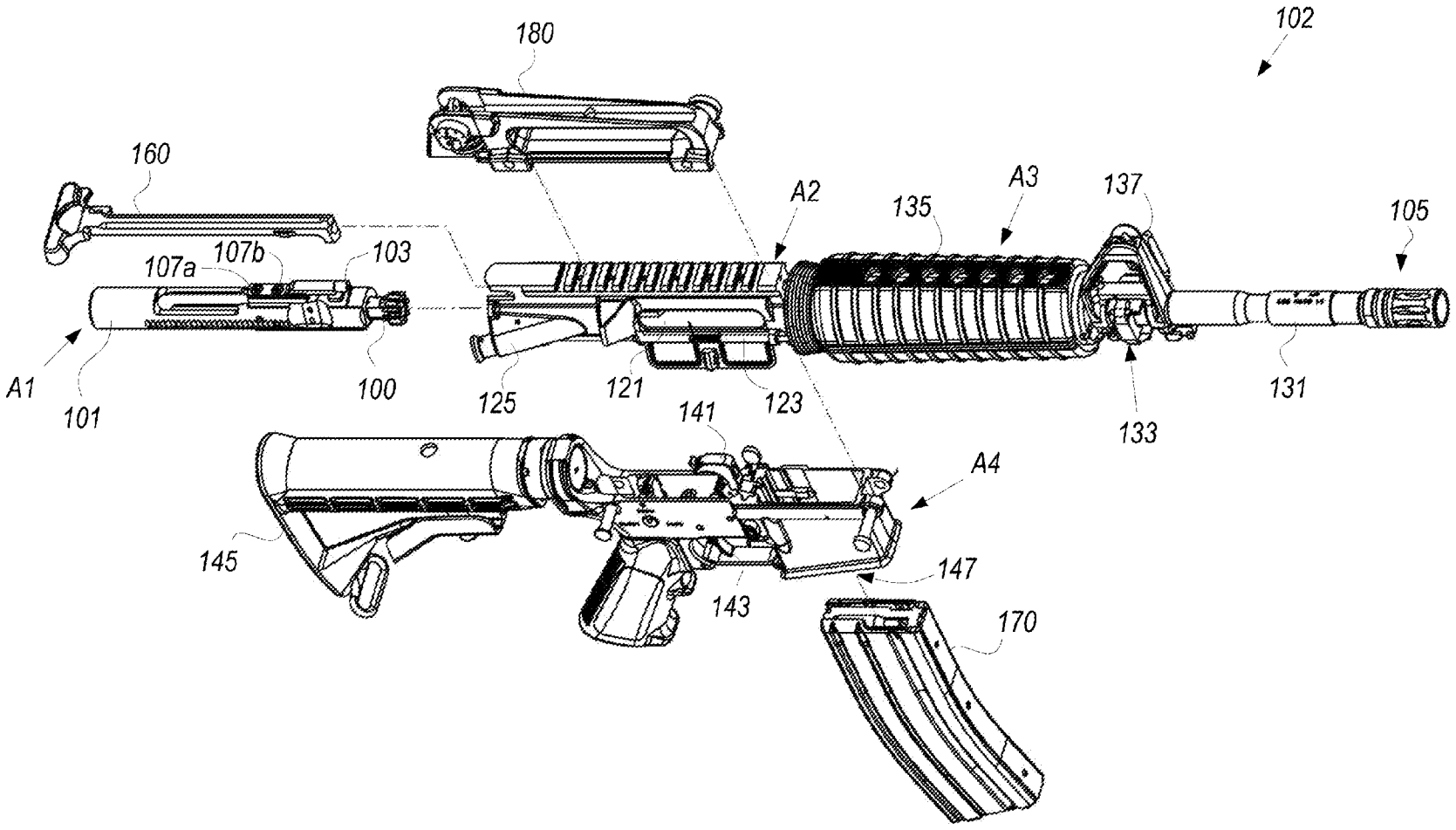
FIG. 1 illustrates an exploded view of a carbine M4 firearm.

In the drawings, like reference numerals designate identical, substantially identical, or corresponding parts throughout the views, e.g., bolt 100 and 200. In the drawings or figures, the terms "left", "right", "vertical", and "horizontal" are based on a viewing perspective of the figure so the captions are located approximately at the center and below a drawing. The term "left" refers to the part of the figure on the left side of the drawing in reference to the caption (e.g., "FIG. 1") located at the bottom of the figure. The term "right" refers to the part of the figure on the right side of the drawing with the caption located at the bottom of the figure.

FIG. 1 is a partially exploded view of a M4 type carbine firearm 102, which is similar to a M16 and AR15 type rifles. While there are differences between carbines and rifles (e.g., barrel length) these differences may be minimal to the present discussion. Further, while various assemblies or components are illustrated, those of skill in the art will appreciate that the illustrated components are not restrictive of the components that can be used or combined to form a fully functional, a substantially fully functional, or a functional firearm. It will be appreciated that the latter may be a firearm that is functional in one or more respects, e.g., substantially all respects, but is inoperative to discharge ammunition, whether a live round or a blank. In some instances, a firearm is rendered inoperative in such a way or to an extent so it is irreversibly or substantially irreversibly rendered inoperative to discharge ammunition. In some examples, combinations of firearm components are rendered, respectively, in operable so the overall firearm is rendered inoperative and/or unsuitable as a source of parts for inclusion in another firearm that is intended to be fully functional. In some examples, the components, subcomponents, mechanisms are modified so the firearm does not meet a predetermined standard. Example standards include, but are not limited to a legal definition of a fully functional firearm or a firearm component.

As noted, a wide variety of components exist for M4/AR15 type firearms, e.g., stocks, barrels, magazines. This is advantageous as it gives gunsmiths flexibility to design a firearm that is well-suited to a particular purpose, e.g., law enforcement or to the needs of a particular user, e.g., shooter. For example, while an adjustable stock is illustrated, such as for law enforcement or urban type situations, in other examples the stock may be a fixed-stock, such as for use in a military setting.

To aid the reader in understanding the principles of the present disclosure various firearm components will now be described. Although a M4 type carbine 102 is discussed, it will be apparent that the principles, approaches, devices, components, methods, and techniques discussed herein are applicable to a wide range of firearms.

As illustrated, a firearm 102 (in the present case a M4 carbine) is formed of a variety of components, most of which include sub-components. As shown, a barrel assembly A3 is connected to an upper receiver assembly A2, in which it houses a bolt carrier assembly. The upper receiver assembly A2 in-turn is attached to a lower receiver assembly A4. For reference, and since many firearms are formed of interchangeable components, the lower receiver assembly is considered as the serialized firearm "gun" for legal/regulatory purposes.

Attached to the lower receiver assembly A4 is (in this case) an adjustable stock 145 and the lower receiver assembly A4 is configured to receive a removable magazine 170. The illustrated magazine 170 is capable of holding ammunition that is fed into the firearm 102 as discussed below. The magazine 170 includes a spring that biases the ammunition toward the chamber barrel 121. The magazine 170 is releasibly retained within the lower receiver via a latch or catch mechanism that is operable to allow the magazine to be removed or otherwise come free of the firearm, such as by use of a thumb lever or a biased button type mechanism which moves the lock mechanism from engaging with at least a portion of the magazine's body.

As illustrated, a bolt carrier assembly A1, including a bolt assembly is contained in the upper receiver assembly. The bolt carrier assembly A1 is operable to slide in the upper receiver generally along a primary axis of the barrel 131, and is positioned to the rear of the barrel's chamber within the upper receiver A2. The bolt carrier assembly A1, or a subcomponent thereof, and an interior recess defined by the upper's main body may be formed in a lock and key type manner 103 or in a rail/groove configuration. Examples of this include the bolt carrier assembly A1 and the inwardly facing walls of the recess having corresponding rails/grooves, or one or more protrusions (boss) match with corresponding grooves. These types of arrangement can keep the action, e.g., bolt carrier assembly A1 aligned in the upper receiver A2. As illustrated, the bolt carrier assembly A1 includes a key, or a bolt carrier key 103, that is secured by two screws 107 *a*, 107 *b* to align the bolt carrier assembly A1 into the charging handle assemble. The charging handle assemble 160 is then guided or aligned into the upper receiver.

The charging handle assembly 160 provides initial charging of the firearm and locks in the forward position during sustained fire. During initial charging the charging handle assembly 160 is configured to pull or retain the bolt carrier assembly A1. The rearward movement of the charging handle assembly 160 pulls the bolt 100 and bolt carrier assembly A1 out of battery or into an open position. The open position allows the firearm to be loaded, unloaded or clear ammunition/mechanical malfunctions.

The bolt assembly in operation moves between a closed position, where the bolt assembly is locked into the chamber of the barrel and an open position in which the bolt assembly is further away from the barrel chamber relative to the locked position. It should be apparent that subcomponents of the bolt assembly are part of the cycle of operation of the firearm (e.g., chambering, locking, firing, unlocking, extracting and ejecting, but will be subsequently discussed. The locked position is attained whenever a firing pin, if included, is adjacent to the primer of a cartridge. The locked position allows the firing pin to strike the primer to ignite the propellant. The portion of the barrel into which the cartridge is loaded is referred to as the chamber. In an open position as illustrated the chamber is defined by the bolt assembly and the barrel. As illustrated, the chamber is generally referenced as item 121. It will be apparent that the end of the bullet will be positioned in the barrel so as to substantially enclose the cartridge between the bolt assembly and the barrel. The bolt assembly is held in the locked position by the bolt locking lugs and the barrel extension. The locking lugs lock the bolt assembly within the chamber of the barrel.

After firing, the bolt assembly is driven toward the open position, e.g., away from the chamber of the barrel by gases produced from the burning powder within the barrel through the gas port. The gasses are channeled by what is referred to as a gas tube. In operation gasses in the barrel from a previous shot (discharge of ammunition) escape through the gas tube and drive the bolt and bolt carrier assembly away from the barrel to eject the spent casing out of the chamber and chamber another round from the magazine into the chamber for firing. The bolt assembly includes an extractor that engages the shellcase head. The extractor enables the bolt assembly to pull the spent casing out of the chamber/barrel as the bolt assembly moves away from the barrel. An example of this is a latch mechanism with an angled surface that faces toward the breech face, to allow the latch to slide past the flange or shellcase head of the casing as the bolt assembly moves toward the barrel, but also includes an opposing surface configured to engage (e.g., hook) the flange or shellcase head of the cartridge to draw the spent casing out of the chamber as the bolt assembly moves in the opposite direction. The foregoing is the arrangement employed by a variety of firearms, such as the M4/AR15

The M4, much like many magazine fed firearms, is configured to lock in the open position when the magazine is out of ammunition. The foregoing may be done to prevent the firearm from dry firing. Dry firing is when the firing pin actuates but no ammunition is present (e.g., the firing pin "strikes" an empty chamber), this can damage the firing pin as it is overextended in comparison to when the firearm is loaded and can damage other subcomponents that contact one another during dry firing. Other rationales exist for configuring the action to lock in the open position should another cartridge not be present to be loaded in the chamber.

Figure 6A:
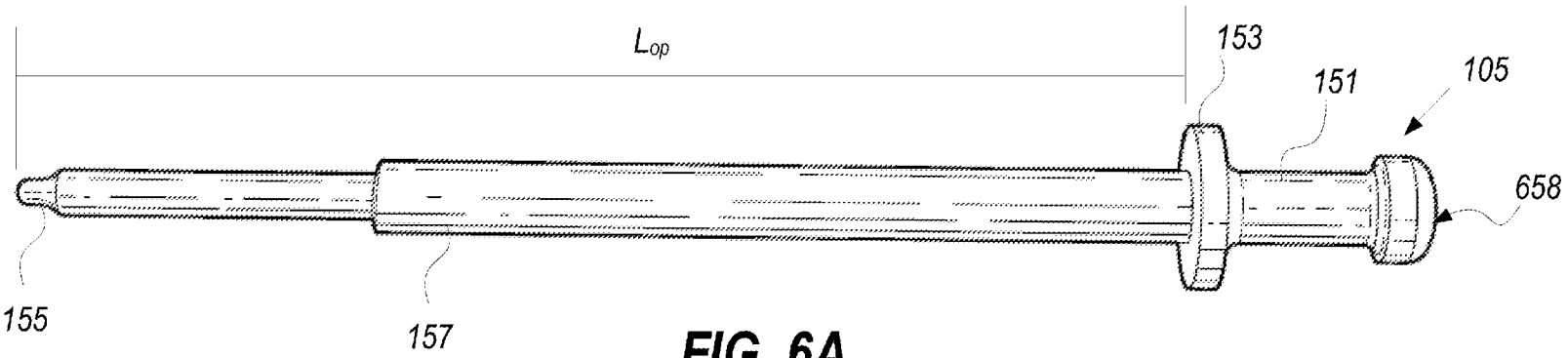
FIGS. 6A and 6B illustrate firing pins, 6B represents a firing pin that in combination with other firearm components that is incapable of firing ammunition.
Figure 6B:
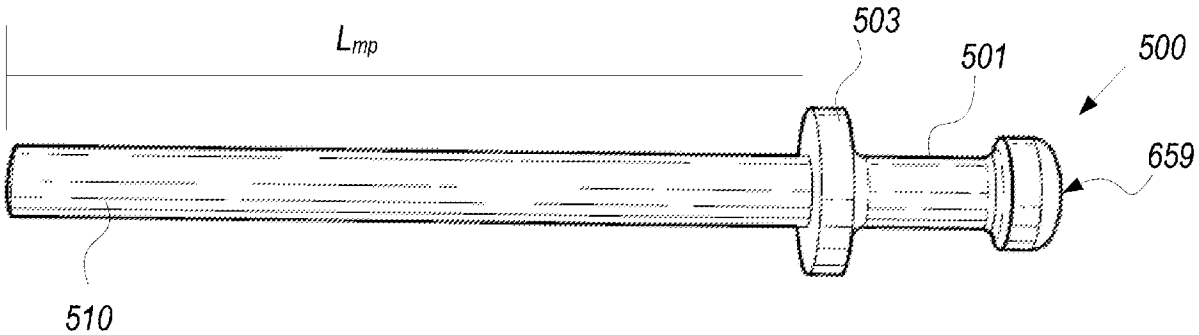

Turning to the lower receiver assembly, as illustrated lower receiver assembly notably includes a trigger assembly and a selector, e.g., a safety. For purposes of this discussion, the trigger assembly will be treated as including the hammer assembly which is operable to rotate, responsive to movement of the trigger to a sufficient degree, to drive the firing pin (105 or 500 as seen in FIGS. 6A and 6B, respectively) into contact with the primer of the cartridge when the action is in the locked position and a cartridge is present.

The trigger 143 is a piece of material, e.g., metal, that is pivotally mounted in the lower receiver A4 and with a curved portion biased toward the barrel 131. The curved portion is configured to accept a user's finger to permit him/her to squeeze the trigger to overcome the biasing force and cause the hammer 141/hammer subassembly to pivot and drive the firing pin to strike the primer. The force necessary to overcome the biasing force, e.g., the trigger spring, is known as the trigger pull or draw.

The hammer 141 as illustrated is pivotally mounted in the lower receiver A4 and cooperates with the trigger 143 when firing by rotating to drive the firing pin generally toward the barrel to strike the primer responsive to the trigger overcoming a catch-type mechanism that hold the hammer 141 away from the action. This presumes a cartridge is present and the hammer is cocked, e.g., is positioned away from the firing pin. The hammer is biased, such as by a spring, which during a firing sequence, drives the hammer into contact with the firing pin. In this configuration, the hammer 141 provides mechanical advantage to ensure the firing pin operates to at least partially crush the primer, e.g., the metal cup holding the primer, to ignite the propellant. It should be apparent that movement of the action, e.g., the bolt carrier assembly A1, away from the barrel 131 after firing can cock the hammer 141 (e.g., rotate the hammer away from the barrel) so it is ready for a subsequent shot. Those of skill in the art will appreciate that a wide variety of trigger assemblies design exist and that the foregoing is provided as an illustrative example and should not be taken as limiting the principles of the present disclosure. Those of skill will also recognize that a firearm can be configured (or selectively configured) as an automatic firearm which cycles through the firing sequence so long as the trigger is depressed (e.g., squeezed) to a sufficient degree.

The lower receiver also includes A4 a safety mechanism that prevents the firearm from discharging ammunition. Safeties range from mechanisms that block or otherwise prevent the trigger assembly from causing the firing pin to have the ability to strike a primer, to mechanisms that rotate the firing pin out of alignment so it is not in an orientation that permits it to strike a primer. Combinations of safety mechanisms can also be implemented.

One example of a safety is a mechanical block that moves into/out of position that physically prevents or blocks the trigger assembly, e.g., the trigger, from obtaining a position that causes the hammer to actuate. This type of safety can function in a variety of ways, two common ways are a sliding mechanism and a pivot mechanism. In the case of a slide type mechanism, a rod or other elongate shape is mounted transverse to the direction of the trigger pull and is configured to slide along its primary axis. Solely for the sake of convenience, the rod will be discussed. The rod can have at one or more positions along it length a recess (e.g., a groove), a protrusion such as a boss, or other type protrusion (e.g., a setscrew) that due to the longitudinal motion of the rod causes the rod or protrusion to block or unblock the trigger from reaching an orientation that causes the hammer to drop and fire the firearm. The rod may be biased or held in place by a spring-type mechanism so it remains in the selected position, e.g., block or unblock.

A rotating safety operates by pivoting into or out of orientations that physically block the trigger assembly, e.g., the trigger 143, from causing the hammer 141 to actuate. A rotating safety can blocks/unblocks the trigger, for instance, by pivoting so a portion of the safety enters the trigger's path of travel to prevent it from triggering the hammer. A pivoting safety can be orientated in-line or transverse to the trigger's path. For example, some shotguns have a pivot safety that mounted at the rear of the upper receiver relative to the barrel and generally opposite the trigger/trigger guard (finger guard).

Having described various component and subcomponents of a firearm, other components of note will be described briefly. It will be apparent that other components, subcomponents can be changed or modified as understood by one of ordinary skill in the art. The inclusion or omission of any particular part, component, subcomponent, feature, or capability should not be taken as an indication of the particular part, component, subcomponent, feature, or capability is unimportant or comparatively more important than other parts, components, subcomponents, features, or capabilities. Although most of the components discussed herein may be mirrored or have an equivalent structure in other firearms, this should not be taken as an indication that the component, part, subcomponent, feature, capability, or its structural or functional equivalent is required.

As further illustrated in FIG. 1 and typical for M4/M16/AR15 type firearms, the firearm includes a forward assist assembly 125, also referred to as a forward assist. A forward assist 125 is an assembly which can be used to force or drive the bolt carrier assembly forward into its locked position. In the case of M16s, a forward assist was added in response to dirt, dust, or debris preventing the action from obtaining its locked position (e.g., properly closing also referred to as being out-of-battery) under jungle combat conditions. A user can manipulate the forward assist 125 by hitting or striking a button type structure that causes the bolt carrier assembly 101 to move forward and/or seat the cartridge. This may also ensure or help to ensure that the extractor (not shown, but is located below 207 in FIGS. 3A and 3B) engages the shell-case head to permit its removal after firing. It will be apparent that in some instances the dirt, dust, or debris may be significant enough so the force applied to the forward assist is insufficient to cause the bolt 100/bolt carrier assembly A1 to obtain the locked position.

As illustrated, the firearm 100 and in particular the upper receiver is configured with a "rail" which can be formed as a set or other configuration of rails/grooves, protrusions/recesses on in this instance the upper receiver to releasibly mount accessories to the firearm 102. As shown, the upper receiver A2 includes two longitudinal protrusions or rails that permit an accessory to clamp to the upper receiver. Although two protrusions are used to interlock with corresponding structures on an accessory, some refer to the overall structure as a "rail." The accessory is a rear sight 180 (e.g., a ramp rear sight) that can also function as a handle. Other accessories include, but are not limited to, optical or holographic scopes, laser guides, optical systems, light sources, the like accessories, and combinations thereof. Although a variety of possible mechanisms can be used to secure or clamp an accessory to the rail, on common approach is to use one or more set screws to affix the accessory to the firearm. Another common location on the firearm for a rail system is along the bottom of a handguard 135 (e.g., adjacent the magazine), which is where a flashlight-type or laser-type accessory may be mounted.

As shown, the accessory is rear sight 180 is a ramp-type sight which is adjustable. While the rear sight is illustrated as being releasibly coupled to the firearm via the upper receiver, in other embodiments a rear sight, whether adjustable or not, may be integral with the upper receiver A2 or at least partially integrated with the firearm, e.g., the upper receiver's main body. Those of skill in the art will appreciate that a wide variety of fix and adjustable sighting systems exist and it is the intention of this disclosure to encompass and include such variation. Examples include, but are not limited to open sights (whether V or U type), aperture (also referred to as a ring or loop type sight), red dot sights, peep sights, and so forth.

As also illustrated in FIG. 1 , the barrel assembly A3 includes a handguard 135, a front sight 137, and a barrel 131. A flash suppressor is also illustrated. The handguard 135 extends generally around the barrel 131 for ease of grasping and preventing a user from contacting the barrel 131, which may become hot after repeated firing. While the handguard 135 is included partly for preventing contact with a hot barrel, it is formed with one or more apertures that extend through the body of the handguard to permit air to pass in order to cool the barrel. The front sight 137 is used to accurately air or point the firearm. For example, the front sight 137 and rear sights 180 are used to aim where the bullet will hit down range. Additional features and embodiments will be discussed in conjunction with the remaining figures. It should be appreciated that the various components (e.g., assemblies), subcomponents, techniques, approaches, and methods can be used with those described in conjunction with that described in conjunction with FIG. 1. It will also be apparent that the various components (e.g., assemblies), subcomponents, techniques, approaches, and methods can be combined or varied for a variety of purposes consistent with this disclosure. In embodiments, one or more of the components, subcomponents, mechanisms, or devices are modified so a firearm containing that components, subcomponents, mechanisms, or devices is incapable of firing ammunition, e.g., igniting a primer. It should be apparent that more than one component, subcomponent, mechanism, or device can be configured so it is impractical to render the firearm containing that component, subcomponent, mechanism, or device into a firearm that can fully function to discharge ammunition.

Figure 2A:
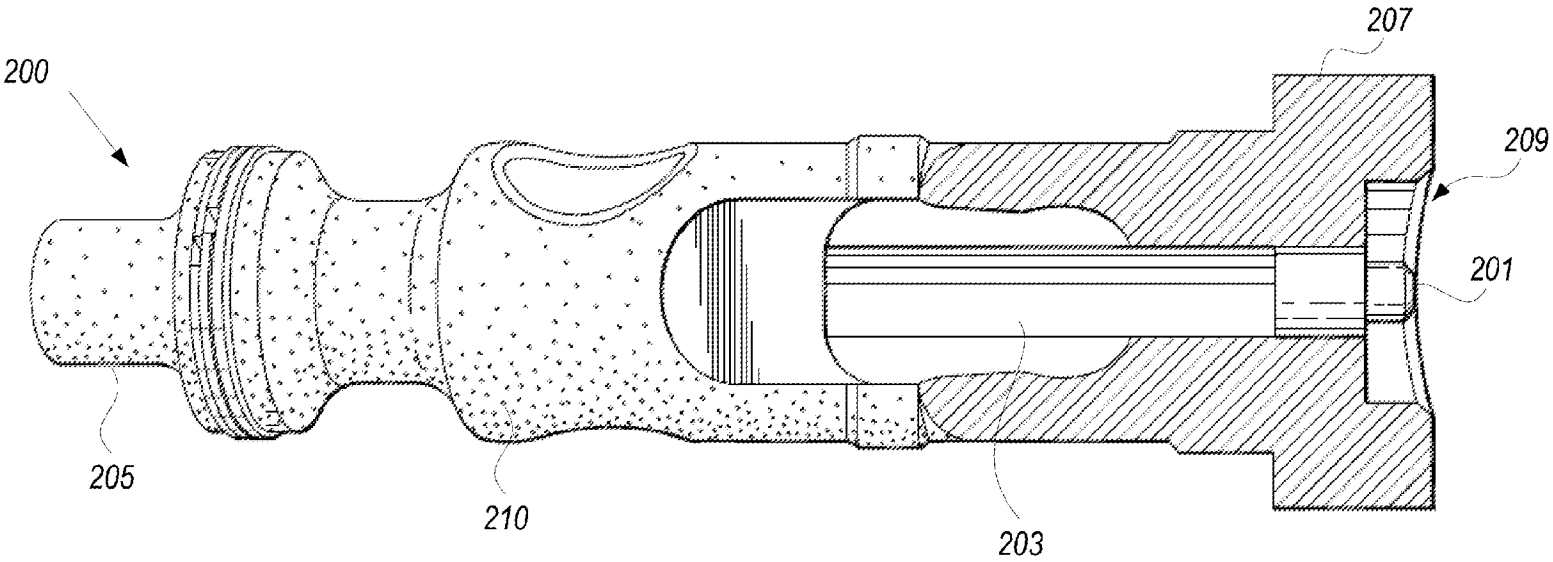
FIG. 2A illustrates a bolt including a firing pin plug that can be implemented in a firearm according to an embodiment of the present disclosure.

FIG. 2A is an illustration of a bolt 200 that is substantially similar to that illustrated in FIG. 1. Bolt 200 can be constructed to render a firearm that includes the bolt 200 functional in substantially all respects, but incapable of firing ammunition, e.g., causing a primer to ignite.

For example, in FIG. 2A, bolt 200 includes an interior void, e.g., a firing pin channel 203 (this is to say the bolt defines a channel or void), which extends along a primary axis of the bolt 200. The firing pin channel 203, relative to a functional channel or combination of firing pin channel 203 and firing pin 105, 500 is enlarged, e.g., a ratio of the firing pin channel's diameter to that of the firing pin 105, 500 is greater than that of the firing pin channel 203 and firing pin 105 that are operable to, in combination with other portions of the firearm, fire ammunition. In embodiments, a firing pin plug 201 with a diameter equal to, substantially equal to or slightly larger than the diameter of the firing pin channel 203 can be included to block the channel. As illustrated the firing pin plug 201 is inserted on an end of the bolt 200 which is to face toward the barrel 131 when assembled into the upper receiver A2. Those of skill in the art will appreciate that the firing pin plug 201 can be sized relative to the size (diameter) of the firing pin channel 203 and accounting for other factors such as engineering tolerance and so forth. Although the firing pin plug 201 can be attached in a variety of ways, in some embodiments the plug is attached in a manner (e.g., physically connected to the bolt) in a manner that renders the bolt inoperative to ignite a primer. In some embodiments, the firing pin plug 201 is physically connected with the bolt 200 so that removal of the plug would result in damage to the bolt that is sufficient to render the bolt inoperable, e.g., inoperable for discharging a cartridge. For example, the firing pin plug is friction fit to the bolt to a sufficient degree so removal of the plug 201 would damage the bolt 200 sufficiently to make it unsuitable for use in a fully functional firearm. In some embodiments, the plug and bolt are secured to one another to a sufficient degree so a firing pin that is greater than the insufficient length would be damaged in attempted assembly instead of the plug becoming dislodged.

In an embodiment, the firing pin channel 203 has a diameter of at least one of 0.155 inches, approximately 0.155 inches, or substantially 0.155 inches at a bolt stem 205 end of the bolt 200. This diameter is constant or substantially constant along the entire length or substantially the entire length of the bolt 200 in embodiments in accordance with the present disclosure. In comparison, an operable bolt can include a bolt face portion of the channel that tapers to a diameter of at least one of 0.060 inches, substantially 0.060 inches, or approximately 0.060 inches. In examples the foregoing conforms to the size, shape, or a combination thereof of an operable firing pin.

In an embodiment, the firing pin channel 203 is shaped to accept the firing pin plug 201 with a diameter that is greater than the diameter of the firing pin channel 203. For example, the bolt face 209 is drilled to 0.125 inches, substantially 0.125 inches, or approximately 0.125 inches deep while the remaining part of the firing pin channel 203 can have a diameter that corresponds to that of a functional bolt, firing pin channel, firing pin, or combinations thereof. An example of the latter is a firing pin channel and firing pin combination with a ratio that is indicative of a functional bolt, e.g., are functionally able to ignite a primer such as by at least partially crushing a portion of the primer's housing.

Configuring the bolt 200 (e.g., firing pin channel) in this manner can render the bolt and firing pin chamber 203 irreversibly incapable of functioning to ignite a primer or to such an extent that attempting to remove the plug would damage the bolt 200 sufficiently that it is unusable in a firearm that is fully functional. In this way, a firearm containing the bolt 200 is capable of functioning, but is incapable of discharging ammunition. Also, in some examples the bolt 200 is unsuitable as a source of parts for inclusion in another firearm. A firearm with a bolt 200 in accordance with this embodiment can still function in substantially all respects other than to ignite the primer. For example, a firearm containing such a bolt substantially reflects a firearm that is fully functional, but has been innocuously rendered inoperable. This can make a firearm containing the bolt 200 suited for training because it is incapable of firing while still retaining the components, subcomponents, mechanisms, and so on of a firearm that is fully functional. As mentioned, the plug 201 in some embodiments is sufficiently innocuous so it is suitable for training use or illustrating the principles of operation of a fully functional firearm.

Figure 2B:
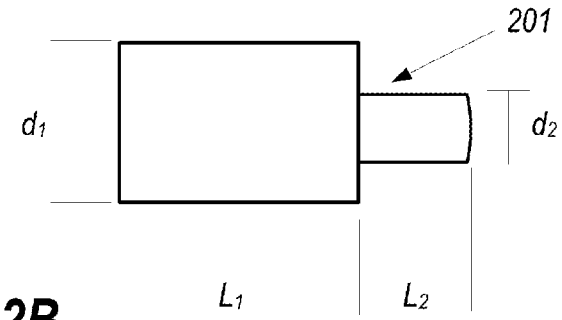
FIG. 2B illustrates a firing pin plug according to an embodiment of the present disclosure.

In an embodiment illustrated in FIG. 2B, the firing pin plug 201 has a stepped cylindrical shape, e.g., the plug's cross-section along it primary axis is concentric such that cross-section narrows from one end of the plug to the opposite end in a stepped manner. In an embodiment, a first step has a diameter $d_1$ for length $L_1$ and a second step having a diameter $d_2$ for length $L_2$. In an embodiment, $d_1$ is 0.160 inches, approximately equal to 0.160 inches, or substantially 0.160 inches, and $d_2$ can be 0.130 inches, approximately equal to 0.130 inches, or substantially 0.130 inches. Because the firing pin plug 201 has a greater diameter than the diameter of the firing pin channel 203, in embodiments a friction fit is created between the firing pin channel 203 and the firing pin plug 201 so removal of the firing pin plug 201 from the firing pin channel 203 cannot be achieved absent effort that would result in damage to the bolt and firing pin. Rendering the bolt 201 and firing pin 500 inoperative in this manner prevents it from being functionally capable of discharging ammunition, but does not otherwise interfere with how the bolt and firing pin functions in the training firearm. Additionally, a firearm containing a firing pin plug 201 remains suitable for demonstrating substantially all or approximately all the firearm's features while ensuring it cannot discharge ammunition. In other embodiments, the firing pin plug 201 is conical or prismatic in shape. The firing pin plug 201 may be deformable, for example the hardness of the metal used in the plug 201 in comparison to the metal used in the bolt 201 may be such that the plug deforms as part of securing the two together. This may prevent or aid in preventing removal of the plug and make it a different shape after securing it to the bolt.

In embodiments, the firing pin plug 201 is press-fit into the firing pin channel 203. For example a hydraulic press is used to secure the plug 201 and bolt 200 to one another. Other securing techniques include, but are not limited to, welding, soldering, adhering, gluing, and combinations thereof. In this manner, the firing pin plug and bolt are fixed so the plug cannot be removed without damaging the bolt. Damaging a bolt effectively renders a firearm containing the bolt inoperable for use in discharging the firearm.

In an example, the bolt 200 is secured in a hydraulic press to permit insertion of a punch into the bolt stem 205 until is rests against the firing pin plug 201. The punch is used to transfer between 1500 to 2000 pounds of pressure per square inch or approximately 1500 to 2000 pounds of pressure per square inch to permanently seat the firing pin plug 201 into the bolt face 209 end of the bolt 200. The particular pressure used is based on a variety of factors including but not limited to the hardness of the bolt, the hardness of the firing pin plug, the relative diameters of the plug 201 and the firing pin channel (this is to say the interior wall of the bolt that defines the firing pin channel), shape of the plug's outer walls (e.g., straight or containing at least a portion that is tapered) and the like factors that influences seating of the plug 201 within the bolt 200, e.g., the plug seating with the walls defining the firing pin channel.

In some embodiments, the plug 201 and/or bolt face 209 end is ground down or refaced (such as by removing all portions of the firing pin plug that extends beyond the bolt face) to prevent or minimize the likelihood of successful extraction. Removing or minimizing a portion of the plug 201 can effectively prevent subsequent removal of the plug and render the bolt 200 permanently or substantially permanently unsuitable for use in discharging a cartridge.

In embodiments, the bolt 200 is rendered identifiable as being inoperable to discharge a cartridge such as by a visual marking. An example of this is rendering an exterior portion of the bolt (e.g., an outer surface) visually identifiable, e.g., colored red, under casual visual inspection, such as may be recognizable to a casual or novice observer in comparison to visual identification as to the presence of a firing pin plug, which would involve greater attention and/or firearm knowledge. For instance, as part of rendering a bolt inoperable to discharge a cartridge, at least a portion of an outer surface of the bolt is made identifiable. An example of the foregoing is texturizing the bolt outer surface, such as by sandblasting it to generate a dimpled or mottled surface to identify it as having been rendered incapable of discharging a cartridge, e.g., incapable of permitting an included firing pin to at least partially crush a primer. Other visual identification techniques include, but are not limited to, acid etching, painting, coating such as powder coating or chemical coloring, bluing, anodizing, and combinations thereof. In this manner, a bolt 200 having a firing pin plug 201 is readily identifiable as being inoperable to discharge a cartridge, such as when it is combined with other components to form a firearm. In the preceding situation, the bolt 200 is identifiable because it is visibly different from fully functional bolts that have smooth outer surfaces upon visual inspection. In other examples, the bolt is rendered identifiable as being in operable to discharge a cartridge by etching or machining a visual cue on the bolt. Example visual cues include, but are not limited to, etched recesses such as grooves that are visually identifiable but serve no functional purpose. Additionally, such markings may be made in areas of the bolt 200 in which it is atypical for a fully functioning bolt to have such a marking.

It should be appreciated that such a combination may include components other than the bolt and bolt carrier assembly that are fully-functional (e.g., are capable in their individual respects to fully-function) or be included with at least some components that are not fully capable or substantially fully capable of functioning in their individual respects. For example, a bolt 200 including a firing pin plug 201 is combined with a lower receiver assembly including a hammer 141 that itself is incapable of actuating an included firing pin 105, 500.

Figure 3A:
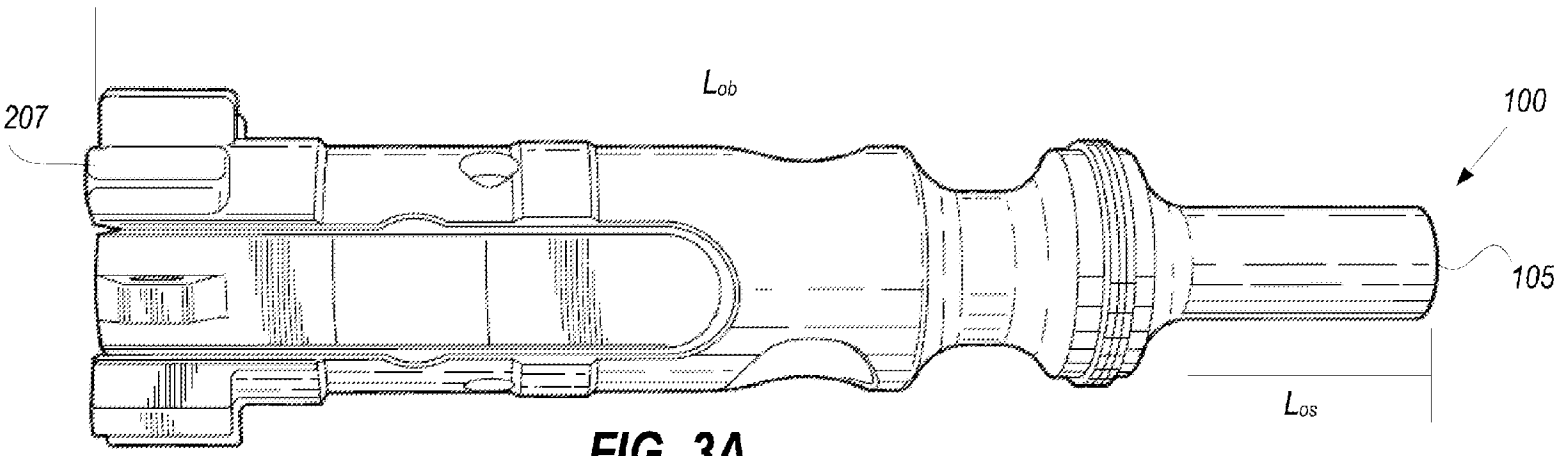
FIGS. 3A and 3B illustrate, respectively, a bolt that is of sufficient length to be fully functional and a modified bolt with its stem of an insufficient length so the bolt is incapable of function/firing a cartridge in according to an embodiment of the present disclosure.
Figure 3B:
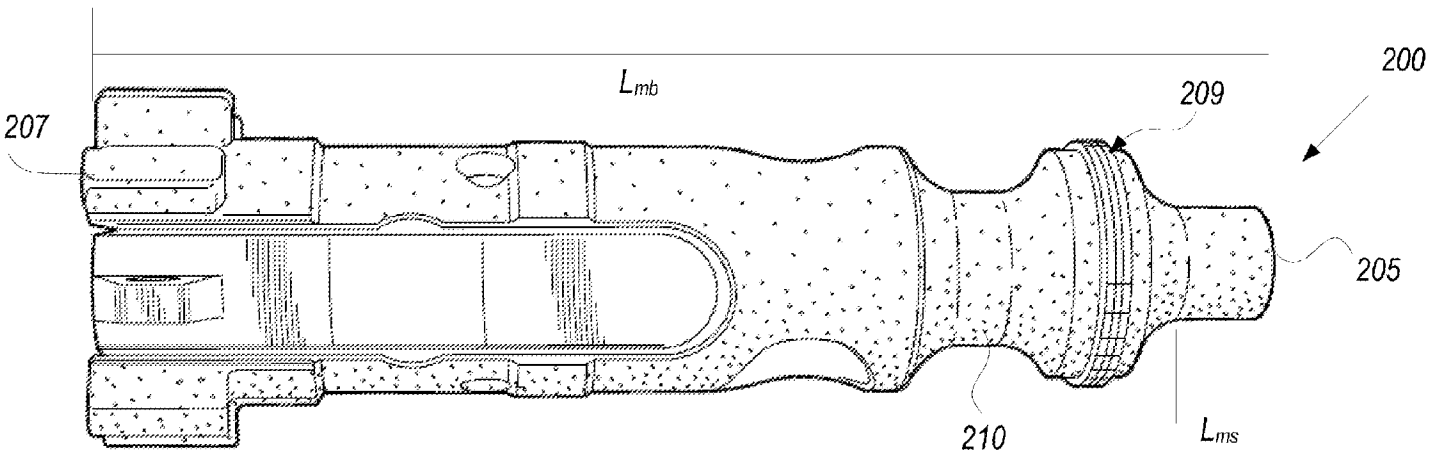

Referring to FIGS. 3A and 3B additional embodiments in accordance with the disclosure are now discussed. In such embodiments, a bolt is constructed so that it is incapable of discharging a cartridge such as when combined with other components of a firearm. It should be apparent that the other components may be fully functional components with respect to their individual functions and capabilities or they (the other components) may be incapable of being formed into a fully functional firearm when combined with additional components that respectively are fully-functional. FIG. 3A is illustrative of a bolt that fully functional in the sense that it has a bolt stem 105 that is of sufficient length $L_{os}$ so that it is capable of fully functioning for its intended purpose in a firearm, presuming length $L_{os}$ is sufficient for the corresponding bolt carrier 101.

As illustrated in FIG. B, the bolt 200 has a total length $L_{mb}$ and the bolt stem 205 has a length $L_{ms}$. In embodiments, $L_{ms}$ is of insufficient length to nest in the bolt-carrier 101 so it permits the bolt in combination with the firing pin and bolt carrier to, along with other components of a firearm (whether fully-functional or not in their own respect) to fire a cartridge. Example other components included, but are not limited to the trigger, hammer, and so forth. It is to be apparent that the length $L_{ms}$ is insufficient relative to a bolt carrier 101 to which it is included. For example, the bolt stem 205 and overall bolt are of sizes relative to the bolt carrier that make the bolt incapable of firing a cartridge. In embodiment, $L_{ms}$ is substantially 0.4 inches in length, approximately 0.4 inches in length, or 0.4 inches in length. The foregoing embodiments are example dimensions for M4/M16/AR-15 type firearms. It should be apparent that these embodiments are not restricted to the notes firearms and other lengths or dimensions would be applicable to different bolt and bolt carrier arrangements.

For example, a bolt stem 205 may be of insufficient length inasmuch as it is incapable of moving, e.g., sliding (such as longitudinally sliding) the bolt carrier 101 sufficiently to permit the bolt and as a result the firing pin to be positioned so the hammer can strike the firing pin to crush or at least partially crush the primer to fire the cartridge. The motion of the bolt 200 in the bolt carrier 101 in part may be restrained by one or more of a carrier key hex head bolt (403, FIGS. 4 and 5) extending into an elongate chamber or channel formed in the bolt carrier into which the bolt is placed or contained an/or an outward extending flange 209 on the bolt contacting a portion of the bolt carrier 101, e.g., interior walls that form or define the walls of the bolt carrier's interior surface. The outwardly extending flange 209, e.g., a flange that extends radially outward from the bolt's primary axis to capture gases from a previous shot in order to drive the bolt 200 away from the end of the barrel 131. Use of a carrier key hex head bolt 403 to restrain or limit motion of the bolt in the bolt carrier will be discussed in further detail below.

Figure 4:
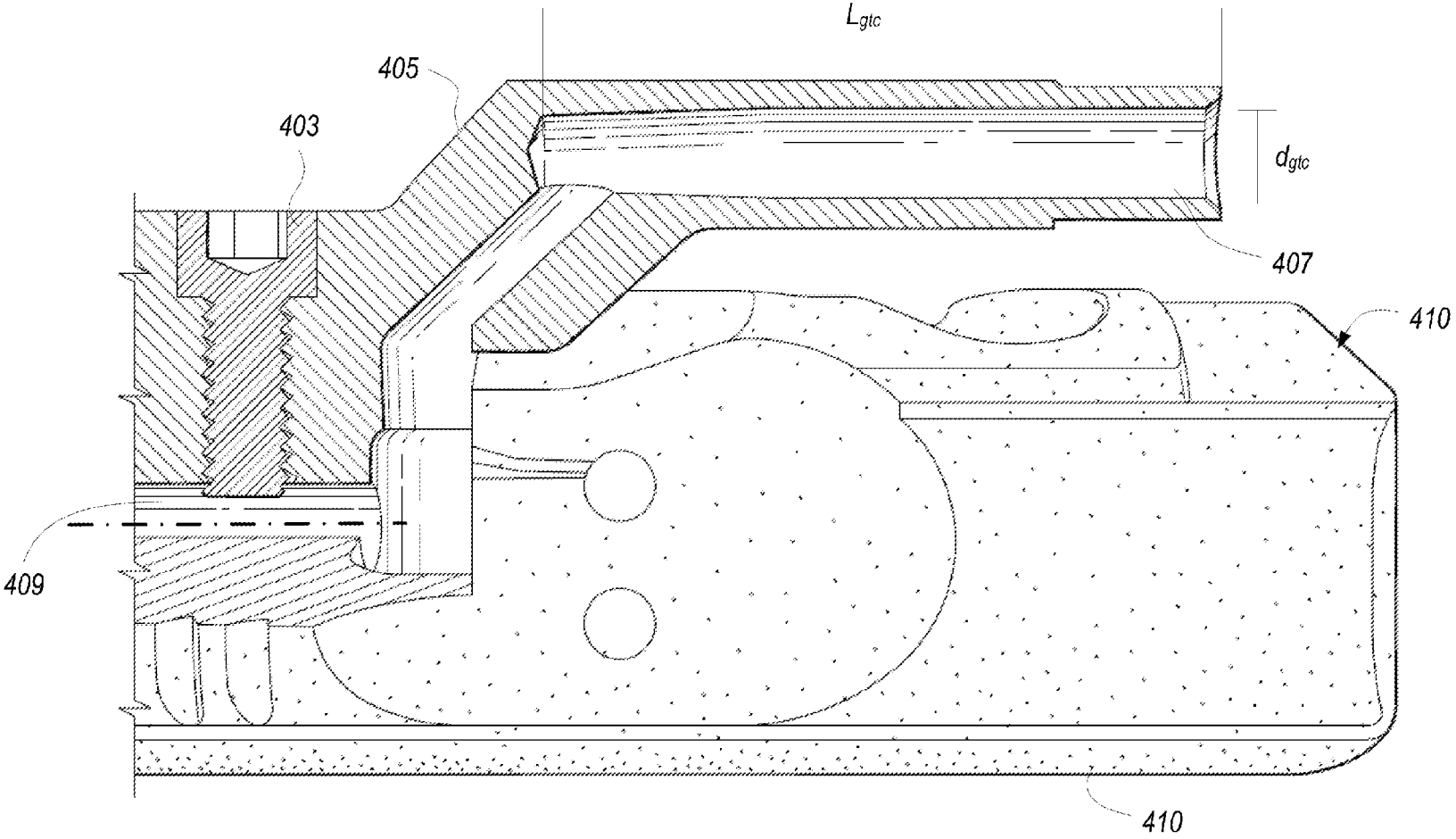
FIG. 4 is a cross-sectional view of a bolt-carrier according to an embodiment of the present disclosure.
Figure 5:
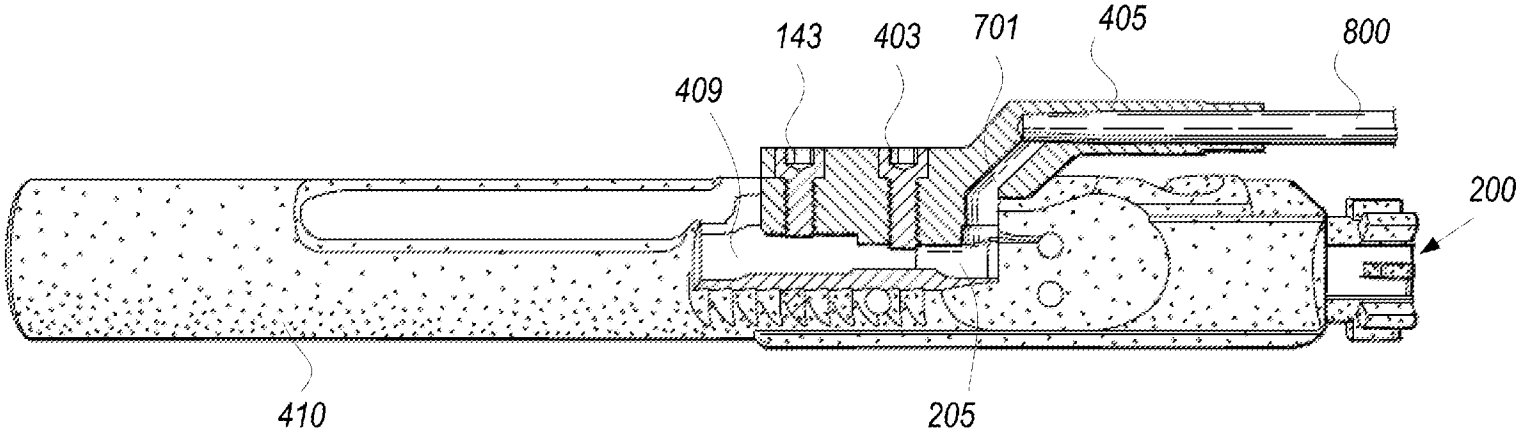
FIG. 5 illustrates a modified bolt carrier. The modifications illustrated are the carrier key and carrier key front hex head socket screw.

Reference will now be made to FIG. 4 and FIG. 5. FIG. 4 is a cross-sectional view of a bolt carrier 410. The bolt carrier 410 includes a carrier key hex head bolt 403 which protrudes into the bolt carrier's channel 409 (e.g., extends medially into the bolt carrier channel) to a sufficient degree that it prevents the bolt stem 205 and bolt from passing by the carrier key hex head bolt . Thus, movement, e.g., sliding of the bolt in the bolt carrier is limited by the carrier key hex head bolt. The foregoing would be applicable whether or not the bolt stem is of a sufficient length (e.g., $L_{ms}$) to render the bolt assembly operable or not. In some embodiments where a bolt stem is greater than the sufficient length (e.g., as if a fully functional bolt was inserted into the bolt carrier), a carrier key hex head bolt 403 that protrudes in to the bolt carrier channel 409 would prevent one or more of the following. Insertion of an unmodified bolt into the modified bolt carrier, the bolt from obtaining a locked position, a bolt carrier from fully seating into an upper receiver, preventing the lower and upper receiver from connecting or combinations thereof.

In some embodiments, a carrier key hex head bolt that is sufficiently elongate so as to prevent the bolt carrier assembly from being operable can be combined with a bolt having an insufficient bolt stem length (e.g., $L_{ms}$) to effectively render the bolt and bolt carrier assembly inoperable to cause a firearm containing them to discharge. With respect to the carrier key hex head bolt 403, in some embodiments it is secured in a manner that makes it sufficiently difficult so as to be impractical to return the bolt carrier to a fully-functional state. For example, the carrier key hex head bolt may be staked into place or the carrier key hex head bolt 403 may be secured using an adhesive such as LOCKTITE (Henkel Corp., Scottsdale, Ariz.) to prevent or inhibit its removal.

Combining a bolt including a firing pin plug 201 and a bolt carrier with a carrier key hex head bolt 403 that extends into the bolt carrier's channel 409 can effectively render the action, e.g., bolt assembly A irreversibly or substantially irreversible inoperative to discharge ammunition and unsuitable for inclusion in a firearm that is intended to discharge ammunition. Bolt and bolt carrier assemblies such as this may exhibit substantially all the functionality of a fully functional bolt and bolt carrier assembly other than the ability to cause a cartridge to discharge. In some embodiments, this makes such bolt and bolt carrier assemblies A1 uniquely suited for training as they are illustrative of a fully functional bolt and bolt carrier assembly, but are unable to discharge ammunition. It will be appreciated that such bolt and bolt carrier assembly are illustrative to substantially all observers except for experts and/or under close inspection.

In some embodiments, a carrier key 405 that is attached to the bolt carrier is modified to prevent an unmodified bolt carrier/carrier key from being capable of fully seating into the upper receiver, thus preventing the discharging of a cartridge, e.g., discharging a cartridge in combination with other firearm components. For example, a carrier key channel's length $L_{gtc}$ is selected to permit a modified mid length gas tube to fully seat, but and unmodified bolt carrier/carrier key in unable to fully seat due to the modified mid length gas tubes length. An unmodified carrier key channel length is sufficient to accept an un modified bolt carrier, but the added length of the modified mid length gas tube prevents unmodified bolt carriers from fully seating. FIG. 4 carrier key 405 is expanded by drilling 0.3 inches, substantially 0.3 inches, or approximately 0.3 inches towards the distal end (e.g., the left side of FIG. 4) with a the diameter of the key channel 407 may remain constant or substantially constant.

The bolt-carrier 410 can be rendered visually identifiable as being incapable of fully functioning in the same or substantially the same manner as that of the bolt, e.g., etchings, surface treatments (e.g., sandblasting, acid etching, painting, coating such as powder coating or chemical coloring), and so forth. In embodiments, the bolt-carrier is colored red to indicate its unsuitability to operate in a fully functional firearm.

Referring now to FIGS. 6A, 6B, 7A, and 7B a firing pin that is inoperative to discharge a cartridge, such as by at least partially crushing a primer is discussed. As can be seen in FIG. 6B a firing pin 500 can be constructed with a length $L_{mp}$ that is insufficiently long to cause a firearm to fire a cartridge. This can occur by constructing the firing pin 500 so it not sufficiently long so the hammer 141 can strike the pin 500 to drive it toward the cartridge. The foregoing presumes a corresponding bolt is of a length so an end of the firing pin that is distal the hammer end (658, 659 respectively) is incapable of striking a primer when the firing pin is inserted into the bolt's firing pin channel. This is to say that length $L_{mp}$ (which extends from a radially outward extending flange on the firing pin to the end of the firing pin that is adjacent to a barrel is insufficiently long to permit it to contact a primer (the firing pin of FIG. 6B). The hammer end of the firing pin is opposite an end that would be designed to strike a primer (e.g., end 155), but for the length $L_{mp}$ being insufficiently long to be in a position that permits it to crush a primer included in a cartridge inserted in the chamber when in a locked position. In an embodiment, length $L_{mp}$ is 0.2 inches smaller than the length $L_{op}$ which corresponds to firing pin which is fully functional, e.g., capable of causing a firearm in which it is included to discharge a cartridge. The foregoing can be applicable for a M4/M16/AR-15 type firearm. Other dimensions can be used in different embodiments or in different firearms.

For comparison, the firing pin of FIG. 6A includes a tapered end portion 155 opposite the other end of the firing pin 105 to at least partially crush a primer to fire the cartridge. The tapered end 155 being an end that is designed to strike a primer and presuming the firing pin has a sufficient length $L_{op}$ that permits a hammer 141 to drive the firing pin to crush a primer and the bolt is of length so the end 155 is capable of striking a primer when the bolt assembly is in a locked position. As also illustrated in FIG. 6A, a portion of the firing pin adjacent the tapered end 155 (the end designed to strike a primer), in embodiments, has diameter that is less than a portion of the firing pin adjacent the flange 153 and other end, e.g., the firing pin is generally cylindrical with a stepped profile.

Figure 7A:
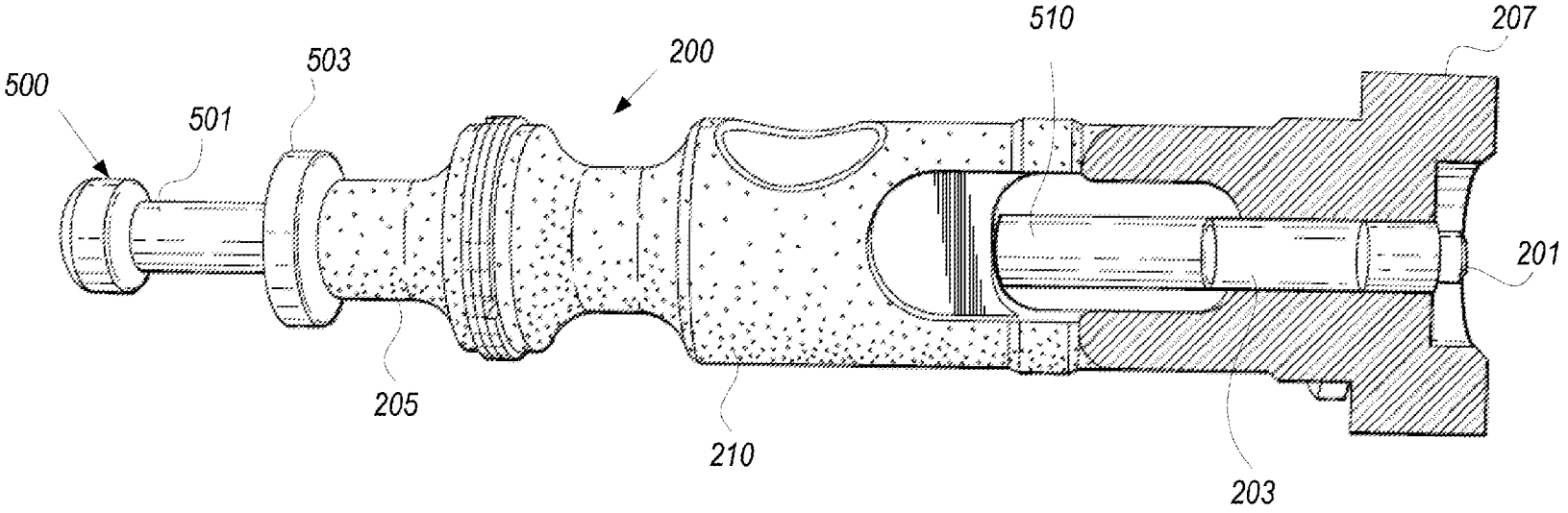
FIGS. 7A and 7B illustrate a modified firing pin capable of fulling seating against the modified bolt stem in accordance with an embodiment of the present disclosure and an unmodified firing pin that is not capable of fully seating against the modified bolt stem or capable of protruding beyond the aft section of the firing pin plug, respectively.
Figure 7B:
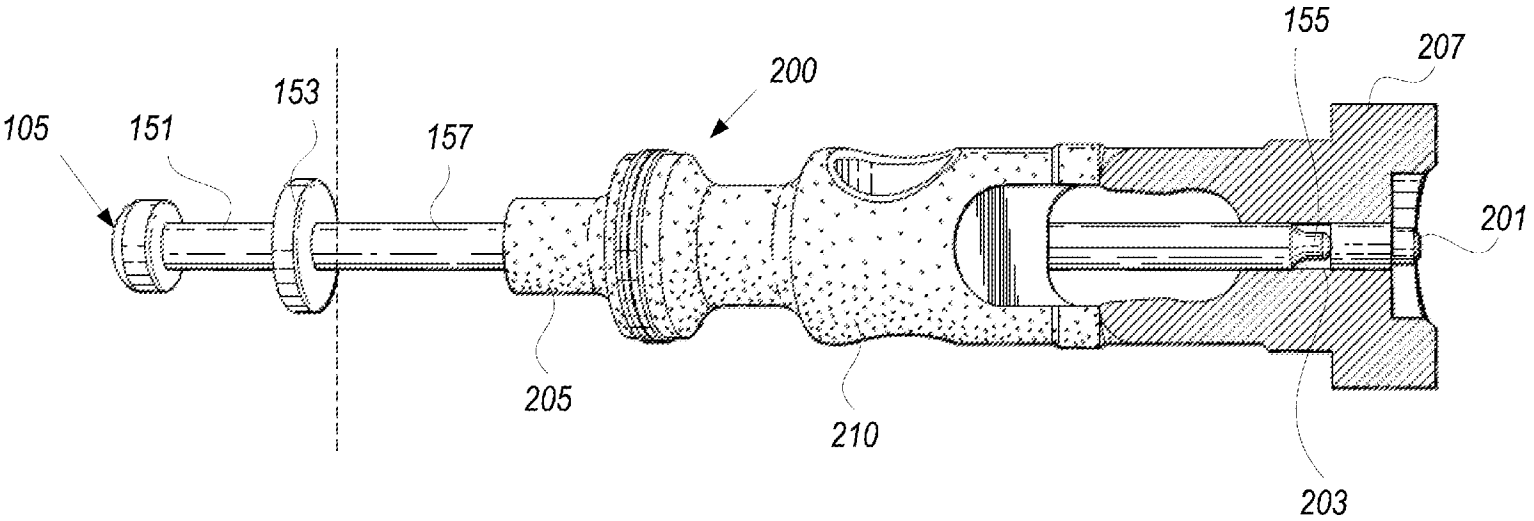

FIGS. 7A and 7B illustrate differences between assembly of a firing pin that is insufficiently long to crush a primer 500 (e.g., the firing pin is of insufficient length to contact a primer seated in the case head of a cartridge) and an attempted assembly of a firing pin that is sufficiently long to discharge a cartridge 105 (e.g., is long enough to be in a position to crush an included primer). Including a firing pin that is insufficiently long can permit a firearm including the pin 500 to serve as an example of a fully functioning firearm in substantially all respects other than to fire a cartridge.

FIG. 7B illustrates a firing pin that is of sufficient length 105, in this example a portion of the firing pin's body extends beyond the bolt stem 205 if the firing pin is assembled into the bolt 200. The firing pin body is the portion of the firing pin that is opposite the hammer end. In embodiments, the firing pin body extends from the flange away from the hammer end 659. If assembled, the firing pin body is oriented generally towards the barrel. As can be observed, the portion 157 extends beyond the bolt stem and would prevent assembling the bolt, cam pin, firing pin and firing pin retaining pin. In some examples, the firing pin and the portion 157 extends beyond the bolt stem due to the presence of a firing pin plug 201.

As illustrated in FIG. 7A, a pin body 510 of a firing pin that is insufficiently length is completely or substantially completely configured to be inserted inside the bolt in the firing pin channel 203 of the bolt 200 through the bolt stem 205, while the flange and other end extends from the bolt. As such, the other end does not project into a position that would permit it to be struck by a hammer, e.g., extend beyond the bolt face 207. In addition to forming a bolt assembly that is incapable of firing a cartridge, a firing pin and bolt combination are still illustrative of substantially all features and functions of a fully functional bolt assembly without the ability to fire a cartridge.

Figure 8:
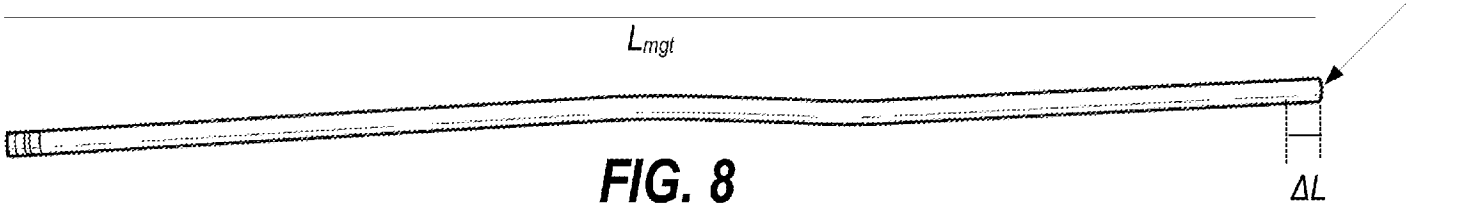
FIG. 8 illustrates a modified gas tube having a length that is greater than that of a gas tube for a fully operable carbine length gas tube system, but less than the length of a fully operable mid length gas tube system. In embodiments, the illustrated gas tube is formed by recycling a gas tube from a mid length gas system.

Referring now to FIG. 8, gas tube 800 in accordance with the present disclosure a described. As can be seen in FIG. 8 a gas tube length can be selected to permit the gas tube 800 to be used with other components in accordance with the present disclosure. For example, a gas tube for a mid length rifle has a shortened length $L_{mgt}$ in comparison to a fully functional gas tube having a length $L_{ogt}$ for a mid length gas system firearm so that it is suitable for use with one or more of the bolt, firing pin, bolt carrier that respectively are incapable of functioning to cause discharge of a carbine containing the component or combination of components. In some embodiments, the gas-tube length $L_{mgt}$ is selected so it is shorter than that of a fully functional mid length rifle gas-tube ($L_{ogt}$), but it is longer ($\Delta L$) than a gas tube for a fully functional carbine gas tube $L_{sgt}$. In this way, a gas tube in accordance with the present embodiment prevents an unmodified bolt carrier from seating in the upper receiver as previously mentioned in paragraph In an example, $L_{mgt}$ is 1.6 inches, approximately 1.6 inches, or substantially 1.6 inches less than $L_{ogt}$ that is associated with a fully functional gas tube for a mid length M16 type rifle.

Figure 9:
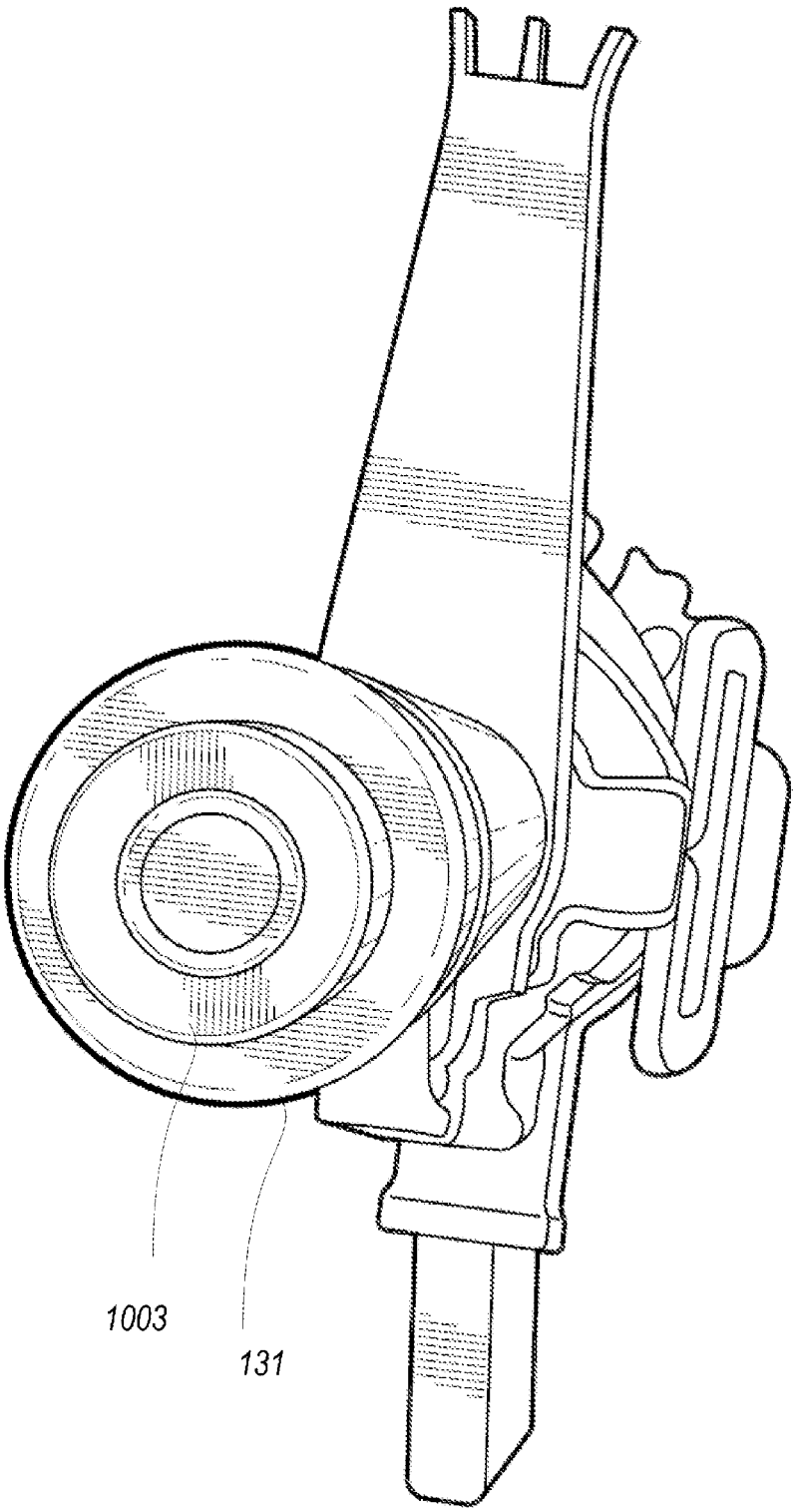
FIG. 9 illustrates a modified barrel of a firearm according to an embodiment of the present disclosure.

Referring now to FIG. 9, in an embodiment a barrel 103 includes a barrel plug 1003 to render it unsuitable to discharge a bullet. In embodiments, the barrel plug 1003 is press or friction fit into the barrel using a hydraulic press. Other suitable mechanisms include welding, soldering, adhering, gluing, and combinations thereof. As illustrated, the barrel plug 1003 is positioned in the barrel 131 so it at least partially extends out of the barrel on an end opposite the upper receiver assembly. Positioning the plug in this manner permits it to be observed upon close inspection. It should be appreciated that while the plug 1003 may extend out of the barrel 131 it may be hidden or at least partially hidden by a flash suppressor 1005. In other instances, the plug 1003 is fully or substantially fully inserted in order to prevent removal. In embodiments, removal or attempted removal of the barrel plug 1003 would result in damage to the barrel 131 that would render it unsuitable for use in a fully functional firearm.

Turning again to FIG. 5 which illustrates a bolt carrier that can be implemented with the gas tube 800 inside the carrier key channel . In the illustrated embodiment, the carrier 410 includes a channel that is formed to permit the gas tube 800 to extend further into the carrier 410.

Figure 10:
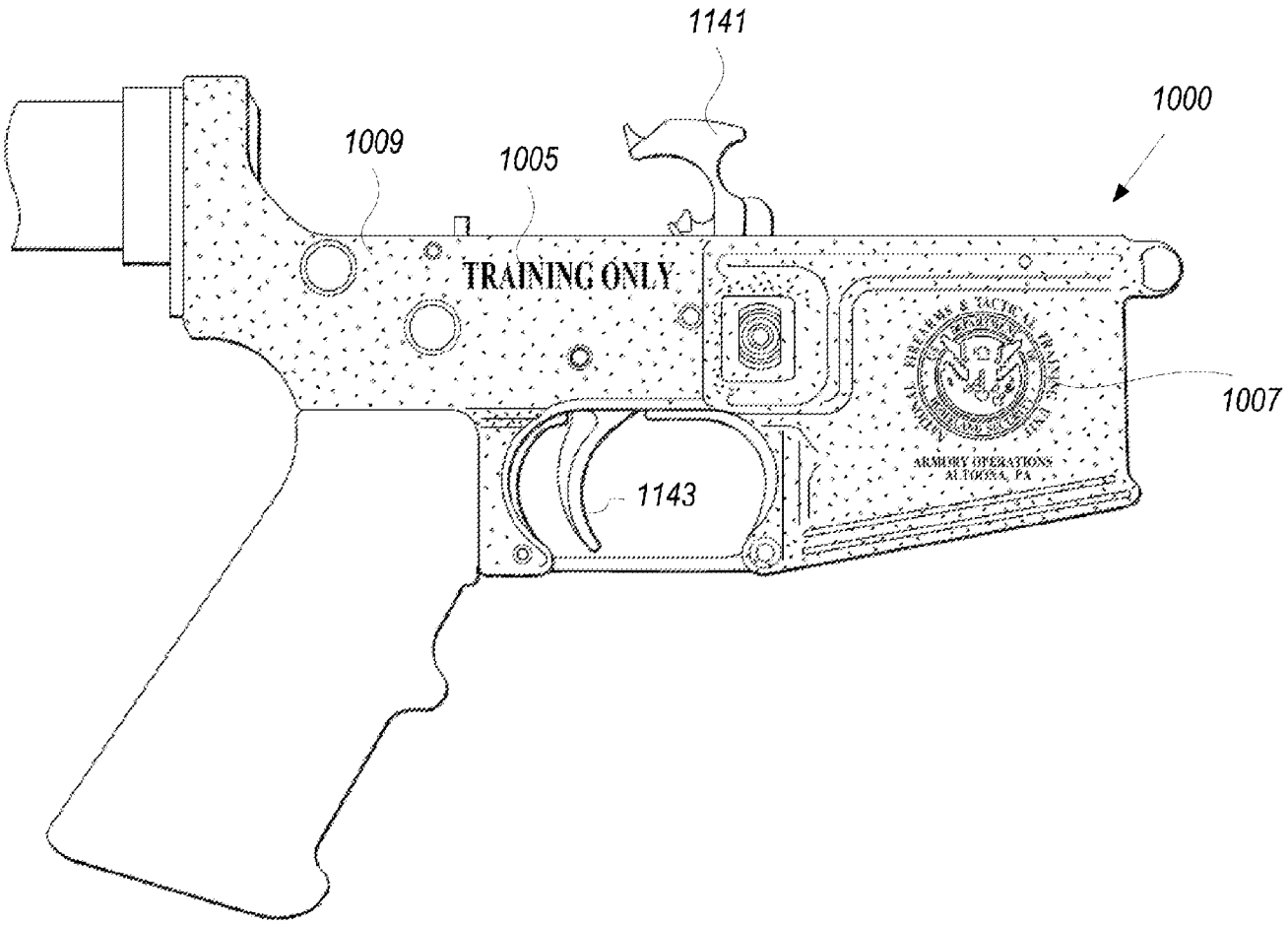
FIG. 10 illustrates visual marking to a firearm according to an embodiment of the present disclosure.

FIG. 10 illustrates external marking that can be done to identify a firearm according to the present disclosure. The external markings can include, but are not limited to: changing a color of the firearm, engraving a phrase and/or a logo on one or more separate components to identify a source or purpose of the modifications, for example the standard upper receiver assembly A2 and the standard barrel assembly A3 can be engraved to reflect that the firearm has been modified for training purposes. Further, the firearm can be marked with color indicia 809 to distinguish the firearm from a standard fully functional firearm which is typically blued or gun metal black in appearance. Further, the internal components of the training firearm can be coated or treated with a similar color (e.g., red), as discussed earlier, to distinguish modified internal components from the internal components of the fully functional firearm. For example, referring to FIG. 10, a lower receiver assembly 1000 of the training firearm can be engraved with a phrase such as "TRAINING ONLY", marked with a military logo 1007, and have color indicia 1009.

Additional modifications can include adapting a hammer 1141 of the lower receiver assembly 1000 such that it does not contact the firing pin (not shown) when a trigger 143 is pulled.

Figure 11:
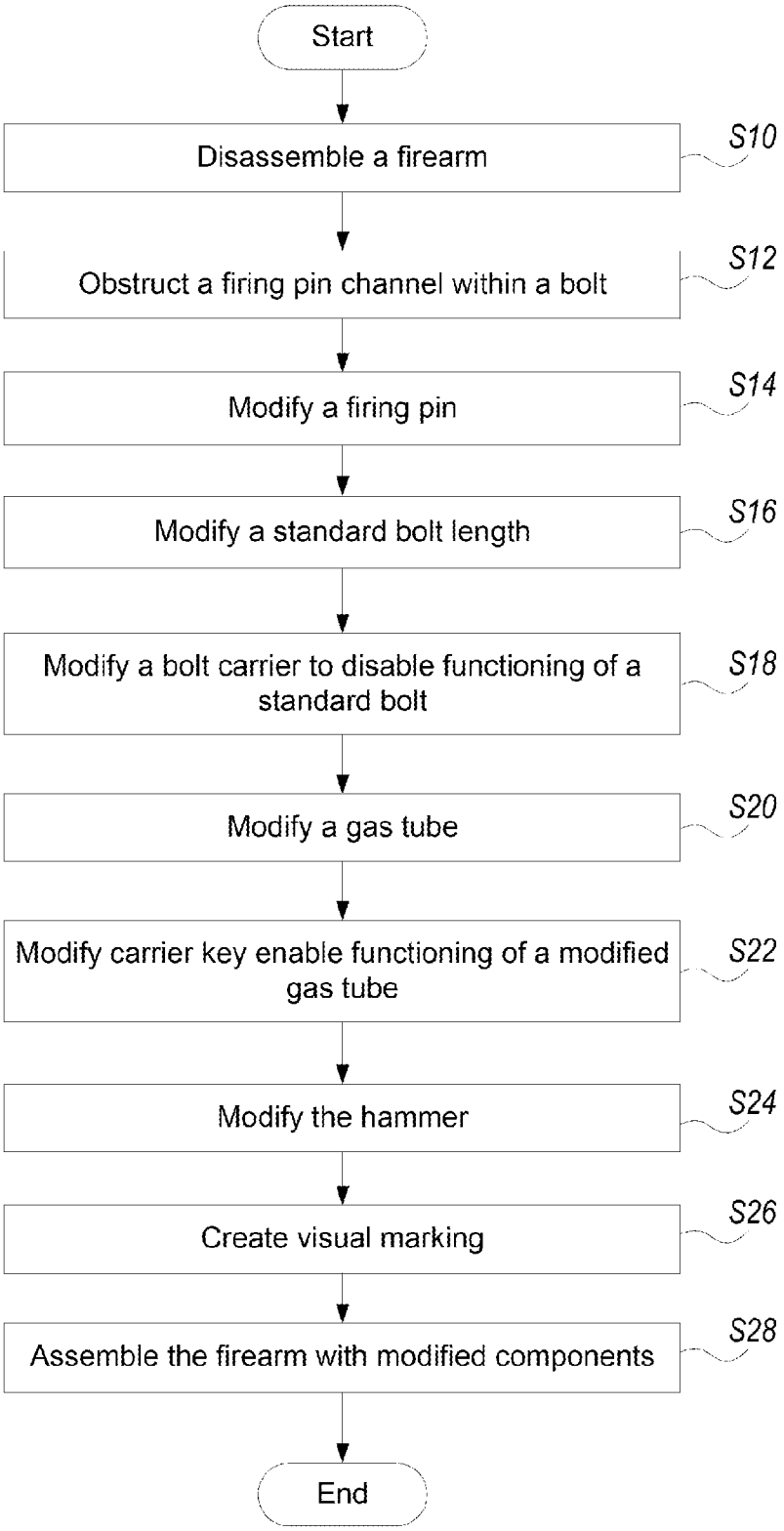
FIG. 11 is a flowchart for manufacturing a firearm that is functional but incapable of firing a cartridge according to an embodiment.

FIG. 11 is a flowchart illustrating a method for manufacturing a firearm that is inoperable to firing a cartridge. In an embodiment, the firearm is manufactured from a firearm that does not fit one or more requirements for operation (e.g., military specification) as a fully functional firearm and are schedule for destruction. In step S10, a standard firearm is disassembled or at least partially dissembled. In this way, a fully functioning firearm that does not meet one or more specifications can be recycled into a training firearm that functions but is not fully functioning. That is, at least some of the internal components of the fully functioning firearm such as a bolt, a bolt carrier, a bolt carrier key, a firing pin, a hammer, a lower receiver, a barrel, and a gas-tube, etc. are disassembled. In step S12, a firing pin channel within the bolt is obstructed. For example, the obstruction is created using the firing pin plug 201 as discussed earlier. In step S14, the length of the firing pin is modified. For instance, see the modified firing pin 500 which has a shorter length than the standard firing pin. In step S16, a bolt length is reduced by cutting off a portion of the bolt stem. For example, the bolt 200 is manufactured by reducing the length of the bolt stem 102 from that of a fully functional bolt.

In step S18, a bolt carrier is constructed to disable functioning of a standard bolt within the bolt carrier. For instance, the length of the carrier key hex head bolt 107*b* is increased by 0.4 inches to extend into the channel in the bolt carrier. As such the standard bolt 100 cannot function or be assembled in the bolt carrier 401.

In step S20, a gas tube for a mid length rifle is shortened so that it is unsuitable for inclusion in a functioning carbine, such as an M4 102. A gas tube having a length shorter than a fully functioning gas tube for mid length rifle is manufactured and used to work with a bolt carrier of the present disclosure for inclusion in a carbine. An example of such a gas tube 800 is discussed in conjunction with FIG. 8. In step S22, the bolt carrier key constructed to accommodate the gas tube. For instance, a length of the key channel of the bolt carrier key 103 is increased to at least partially block a fully functioning bolt carrier from being sufficiently received in the channel 407 to permit assembly in a firearm.

In step 24, a hammer, which is a part of the lower receiver assembly, is configured so it is not operable to strike a firing pin. This prevents the hammer from striking the firing pin assembled in the bolt. For example the hammer is reduced, by grinding, milling etc., the size of the hammer end that comes in contact with the firing pin.

In step 26, visual markings can be added to the internal components of the firearm and also provided on different sub-assemblies of the firearm. The visual markings can be rendered difficult to remove by conventional processes. For instance, a visual marking such as engraving of a phrase or a logo can be provided. Additional visual marking can include coating the internal components and sub-assemblies with an easily identifiable color coating. Further, the color indicia can be applied on sandblasted components which make removal of the color indicia difficult.

In step S28, the modified components are assembled together to create the modified firearm which is incapable of firing. Further, many of the modifications disclosed herein are irreversible, which makes it extremely difficult to convert the modified training firearm into a functional firearm capable of firing a live round.

It is to be understood that the above description is intended to be illustrative, and not restrictive. For example, the above-described embodiments (and/or aspects thereof) may be used in combination with each other or in different orders than that which is illustrated. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

What is claimed is:

1. A functional firearm that has been modified to be incapable of firing a cartridge, the firearm comprising:

a bolt including a stem, a bolt face, and a firing pin channel provided along a length of the bolt from the stem to the bolt face;

a plug fitted longitudinally at the bolt face of the firing pin channel;

a firing pin including a pin stem and a pin body, wherein the firing pin does not include a needle, and when the pin body is placed coaxially inside the firing pin channel of the bolt, the pin stem projects from the stem of the bolt; and a bolt-carrier adapted to receive the bolt in a coaxial manner.

2. The firearm according to claim 1, wherein the plug has a stepped cylinder shape.

3. The firearm according to claim 1, wherein the stem of the bolt has a shorter length than a stem of a bolt used in a fully functional firearm capable of firing a cartridge.

4. The firearm according to claim 1, wherein the pin body has a shorter length than a pin body of a firing pin of a fully functional firearm capable of firing a cartridge.

5. The firearm according to claim 1, further comprising:

a gas tube having a length longer than a gas tube of a fully functional firearm capable of firing a cartridge.

6. The firearm according to claim 4, further comprising a hammer adapted to not strike the firing pin.

7. The firearm according to claim 1, further comprising a visual marking included on at least one component, the marking adapted to be substantially irreversible and formed on the at least one component.

8. The firearm according to claim 7, wherein the visual marking includes indicia that the firearm is inoperable to fire a cartridge and indicia that identifies an entity that rendered it inoperable to fire a cartridge.

9. A functional firearm that has been modified to be incapable of firing a cartridge, the firearm comprising:

a bolt including a stem, a bolt face, and a firing pin channel provided along a length of the bolt from the stem to the bolt face;

a firing pin including a pin stem and a pin body, wherein the firing pin does not include a needle, and when the pin body is placed coaxially inside the firing pin channel of the bolt, the pin stem projects from the stem of the bolt; and a bolt-carrier adapted to receive the bolt in a coaxial manner and fitted with a bolt carrier key using a carrier key hex head bolt that is configured to extend medially into a chamber of the bolt carrier, wherein the carrier key hex head bolt protrudes into the chamber to prevent movement of the bolt in the chamber.

10. The firearm according to claim 9, wherein the bolt carrier key defines a channel that has a substantially uniform diameter throughout its length.

11. A method for modifying a firearm that is fully functional to prevent firing of a cartridge, the method comprising:

obstructing a firing pin channel within a bolt of the firearm;

modifying a length of the bolt of the firearm; and modifying a bolt carrier of the firearm to disable functioning of the bolt of the firearm.

12. The method for modifying a firearm according to claim 11, further comprising:

including a gas tube that is longer than a gas tube originally included in the firearm;

modifying a carrier key of the firearm to enable assembly of the gas tube in the firearm;

modifying a hammer of the firearm so it is inoperable to strike the firing pin; and creating a visual marking on at least one component included in the firearm, the marking being substantially irreversibly formed on at least one component.

13. The method for modifying a standard firearm according to claim 11, further comprising:

fitting a cylindrical plug into the firing pin channel to prevent a firing pin assembled in the bolt from striking a cartridge when the bolt is in a locked position.

14. The method for modifying a standard firearm according to claim 11, further comprising:

shortening a length of the firing pin of the standard firearm.

15. The method for modifying a standard firearm according to claim 11, further comprising:

shortening a length of the stem of the bolt of the standard firearm.

16. The method for modifying a standard firearm according to claim 11, further comprising:

fitting the bolt carrier of the standard firearm with a carrier key hex head bolt that projects into the bolt channel of the standard firearm.

17. The method for modifying a standard firearm according to claim 12, wherein the modifying a gas tube of the standard firearm comprises: replacing the gas tube of the standard firearm with a gas tube having a longer length.

18. The method for modifying a standard firearm according to claim 12, wherein the modifying a carrier key of the standard firearm comprises: drilling a carrier key channel of the bolt carrier key of the standard firearm to create a key channel of a uniform diameter along the entire length of the bolt carrier key of the standard firearm.

19. The method for modifying a standard firearm according to claim 12, wherein the visual marking includes at least one of a color distinguishable from the color of the standard firearm, indicia identifying a purpose of the modifications, and indicia identifying a source of the modifications.

* * * * *